US011410790B2

(12) United States Patent
Kojima et al.

(10) Patent No.: US 11,410,790 B2
(45) Date of Patent: Aug. 9, 2022

(54) SUBSTRATE-MOUNTED ELECTRICAL CONNECTOR FOR CONNECTING TO A SHIELDED FLAT CABLE

(71) Applicant: SUMITOMO ELECTRIC INDUSTRIES, LTD., Osaka (JP)

(72) Inventors: Chiaki Kojima, Tochigi (JP); Tatsuo Matsuda, Tochigi (JP)

(73) Assignee: SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 17/049,688

(22) PCT Filed: Mar. 28, 2019

(86) PCT No.: PCT/JP2019/013705

§ 371 (c)(1),
(2) Date: Oct. 22, 2020

(87) PCT Pub. No.: WO2019/208091

PCT Pub. Date: Oct. 31, 2019

(65) Prior Publication Data

US 2021/0249803 A1 Aug. 12, 2021

(30) Foreign Application Priority Data

Apr. 27, 2018 (WO) ..... PCT/JP2018/017258

(51) Int. Cl.
*H01B 7/08* (2006.01)
*H01B 7/02* (2006.01)
(Continued)

(52) U.S. Cl.
CPC ..... *H01B 7/0823* (2013.01); *H01B 7/0225* (2013.01); *H01B 7/08* (2013.01);
(Continued)

(58) Field of Classification Search
CPC ..... H01B 7/0823; H01B 7/0225; H01B 7/08; H01B 7/0861; H01R 12/775; H01R 12/79;
(Continued)

(56) References Cited

U.S. PATENT DOCUMENTS 5,254,010 A 10/1993 Davis
2009/0269968 A1 10/2009 Nemoto
(Continued)

FOREIGN PATENT DOCUMENTS

EP 2605624 A1 * 6/2013 ..... H01B 7/04
JP 2008-027707 2/2008
(Continued)

*Primary Examiner* — Abdullah A Riyami
*Assistant Examiner* — Justin M Kratt
(74) *Attorney, Agent, or Firm* — IPUSA, PLLC

(57) ABSTRACT

With respect to a connector for attachment to a shielded flat cable including a signal wire and a ground wire arranged in parallel, an insulating layer covering the signal wire and the ground wire; and a first shield layer and a second shield layer respectively covering both sides of the insulating layer, wherein a terminal in which the signal wire and the ground wire are exposed is formed on a first shield layer side at an end in a longitudinal direction, the connector includes a casing, wherein the casing includes a bottom to face the first shield layer or the second shield layer, a top to face the first shield layer or the second shield layer, a side wall connected to the bottom and the top, a signal wire contact member, a ground wire contact member, and the connector further includes a signal wire contact member configured to come in contact with the signal wire of the terminal upon the shielded flat cable being attached, a ground wire contact member configured to come in contact with the ground wire of the terminal upon the shielded flat cable being attached, a first shield layer contact member configured to come in contact with the first shield layer upon the shielded flat cable being
(Continued)

attached, and a second shield layer contact member configured to be electrically coupled to the second shield layer upon the shielded flat cable being attached, wherein the ground wire contact member is electrically coupled to the first shield layer contact member.

10 Claims, 11 Drawing Sheets

(51) Int. Cl.

| | |
|---|---|
| ***H01R 12/79*** | (2011.01) |
| ***H01R 12/77*** | (2011.01) |
| ***H01R 13/6471*** | (2011.01) |
| ***H01R 13/6581*** | (2011.01) |
| *H01R 13/6582* | (2011.01) |

(52) U.S. Cl.
CPC ..... *H01B 7/0861* (2013.01); *H01R 12/775* (2013.01); *H01R 12/79* (2013.01); *H01R 13/6471* (2013.01); *H01R 13/6581* (2013.01); *H01R 12/77* (2013.01); *H01R 12/771* (2013.01); *H01R 12/774* (2013.01); *H01R 13/6582* (2013.01)

(58) Field of Classification Search
CPC H01R 13/6471; H01R 13/6581; H01R 12/77; H01R 12/771; H01R 12/774; H01R 13/6582
See application file for complete search history.

(56) References Cited

U.S. PATENT DOCUMENTS

2013/0337676 A1* 12/2013 Hsueh ..... H01R 13/6597 439/350
2015/0364846 A1* 12/2015 Chen ..... H01R 12/79 439/497

FOREIGN PATENT DOCUMENTS

| | | |
|---|---|---|
| JP | 2009-266440 | 11/2009 |
| JP | 2011-008978 | 1/2011 |
| JP | 2011-198687 | 10/2011 |
| JP | 2014-207162 | 10/2014 |

* cited by examiner

SUBSTRATE-MOUNTED ELECTRICAL CONNECTOR FOR CONNECTING TO A SHIELDED FLAT CABLE

TECHNICAL FIELD

The present invention relates to a connector and a substrate. The present application is based on and claims priority to International Application No. PCT/JP2018/017258, filed on Apr. 27, 2018, the entire contents of which are incorporated herein by reference.

BACKGROUND ART

Flexible flat cables (FFCs) in which multiple parallel conductors are covered with an insulating layer are used for space saving and easy connections in many fields including audio visual equipment, such as CD and DVD players, office automation equipment, such as copiers and printers, and internal wiring of other electronic and information equipment. Here, the higher frequency the equipment uses, the greater an influence of noise is. Thus, shielded flat cables are used. A shield of the shielded flat cable is achieved, for example, by providing a shield layer made of a shielded film outside the FFC (see Patent Document 1).

A connector is used to connect the shielded flat cable to a substrate or the like. In order to avoid the influence of noise in the shielded flat cable, the shield layer is in contact with a metal shell of the connector, so that the potential of the shield layer is maintained at the ground potential of the substrate through the metal shell (see Patent Document 2).

PRIOR ART DOCUMENTS

Patent Documents

[Patent Document 1] Japanese Laid-open Patent Publication No. 2011-198687

[Patent Document 2] Japanese Laid-open Patent Publication No. 2014-207162

SUMMARY OF THE INVENTION

According to the present disclosure, with respect to a connector for attachment to a shielded flat cable including a signal wire and a ground wire arranged in parallel, an insulating layer covering the signal wire and the ground wire, and a first shield layer and a second shield layer respectively covering both sides of the insulating layer, wherein a terminal in which the signal wire and the ground wire are exposed is formed on a first shield layer side at an end in a longitudinal direction, the connector includes a casing, wherein the casing includes a bottom to face the first shield layer or the second shield layer, a top to face the first shield layer or the second shield layer, and a side wall connected to the bottom and the top, and the connector further includes a signal wire contact member configured to come in contact with the signal wire of the terminal upon the shielded flat cable being attached, a ground wire contact member configured to come in contact with the ground wire of the terminal upon the shielded flat cable being attached, a first shield layer contact member configured to come in contact with the first shield layer upon the shielded flat cable being attached, and a second shield layer contact member configured to be electrically coupled to the second shield layer upon the shielded flat cable being attached, wherein the ground wire contact member is electrically coupled to the first shield layer contact member. A substrate according to the present disclosure is a substrate on which the above-described connector is mounted.

EMBODIMENT FOR CARRYING OUT THE INVENTION

Figure 1:
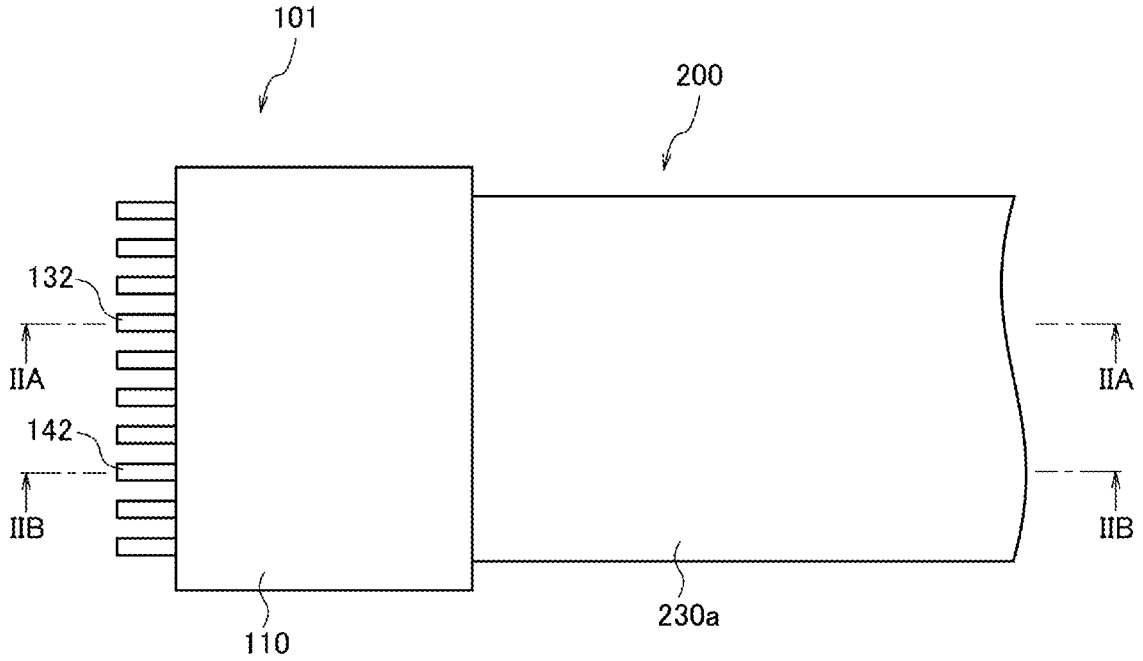
FIG. 1 is a top view illustrating a schematic view when a shielded flat cable is attached to a connector according to a first embodiment of the present disclosure.

[Problem to Be Solved by the Present Disclosure]

In shielded flat cables for high-speed signal transmission, with respect to an array of multiple conductors, it is common that a ground wire is provided on each side of a two-core signal wire. When such a shielded flat cable is attached to a connector, a potential of the ground wire is dropped to the ground potential of a substrate. With respect to the above, in order to maintain the shield layer at the ground potential, as in the shielded flat cable of Patent Document No. 2, a method of dropping the shield layer to the ground potential with the ground wire can be considered in addition to a method of dropping the shield layer to the ground potential through a metal shell. The inventors have found that the latter method of connecting the shield layer to the ground wire and simultaneously dropping the potential of the shield layer and the ground wire to the ground potential improves transmission characteristics more than the former method of using the metal shell.

The present disclosure is based on these findings and it is an object to provide an inexpensive and high-performance connector and a substrate by devising a connector structure without requiring processing of the shielded flat cable for high-speed signal transmission.

[Effect of the Present Disclosure]

According to the present disclosure, the amount and variation of crosstalk in a low frequency range can be greatly improved.

[Description of Embodiments of the Present Disclosure]

First, aspects of the present disclosure will be listed and described.

(1) With respect to a connector according to an aspect of the present invention for attachment to a shielded flat cable including a signal wire and a ground wire arranged in parallel, an insulating layer covering the signal wire and the ground wire, and a first shield layer and a second shield layer covering both sides of the insulating layer, wherein a terminal in which the signal wire and the ground wire are exposed is formed on a first shield layer side at an end in a longitudinal direction, the connector includes a casing, wherein the casing includes a bottom to face the first shield layer or the second shield layer and a top to face the first shield layer or the second shield layer, and a side wall connected to the bottom and the top, and the connector further includes a signal wire contact member configured to come in contact with the signal wire of the terminal upon the shielded flat cable being attached, a ground wire contact member configured to come in contact with the ground wire of the terminal upon the shielded flat cable being attached, a first shield layer contact member configured to come in contact with the first shield layer upon the shielded flat cable being attached, and a second shield layer contact member configured to be electrically coupled to the second shield layer upon the shielded flat cable being attached, wherein the ground wire contact member is electrically coupled to the first shield layer contact member.

With this configuration, the first shield layer of the shielded flat cable is electrically coupled to the ground wire of the shielded flat cable by the first shield layer contact member and the ground wire contact member of the connector, thereby significantly improving the amount and variation of the crosstalk in the low frequency range, which is one of the important transmission characteristics. Further, because the signal wire contact member and the ground wire contact member can be easily mass-produced by pressing or the like, the total cost can be reduced.

(2) The ground wire contact member and the first shield layer contact member may be formed as a single seamless piece. This configuration can reduce the number of connector parts.

(3) It is desirable that the ground wire contact member and the first shield layer contact member that are formed as a single seamless piece are configured to be longer than the signal wire contact member along an insertion direction of the shielded flat cable. With this configuration, when the shielded flat cable is attached to the connector, the ground wire and the shield layer of the shielded flat cable respectively come in contact with the ground wire contact member and the first shield layer contact member of the connector with certainty.

(4) It is desirable that from an input side of the insertion direction of the shielded flat cable, a contact position between the first shield layer and the first shield layer contact member, a contact position between the second shield layer and the second shield layer contact member, and a contact position between the ground wire and the ground wire contact member are positioned in order. This configuration enables the shielded flat cable to be stably fixed in the connector.

(5) The ground wire contact member and the second shield layer contact member may be electrically coupled. This configuration further improves the amount and variation of the crosstalk in the low frequency range because the second shield layer of the shielded flat cable, as well as the first shield layer, is electrically coupled to the ground wire of the shielded flat cable.

(6) The ground wire contact member may be disposed on each side of two adjacent signal wire contact members. This configuration can provide a connector for a differential transmission type shielded flat cable in which the ground wire is arranged on each side of two adjacent signal wires.

(7) The second shield layer contact member may be formed in the metal shell member covering the casing as a single seamless piece. This configuration enhances the noise resistance of the connector.

(8) It is desirable that the metal shell member includes a connection connected to a wiring pad of the ground potential of the substrate on which the connector is mounted. This configuration further enhances the noise resistance characteristics of the connector because the potential of the second shield layer of the shielded flat cable is dropped to the ground potential of the substrate.

(9) It is desirable that the metal shell member includes a connecting piece connected to a solder tail of the ground wire contact member. This configuration further improves the amount and variation of the crosstalk in the low frequency range because the second shield layer of the shielded flat cable, as well as the first shield layer, is electrically coupled to the ground wire of the shielded flat cable.

(10) The metal shell member may include a cover member covering solder tails of the signal wire contact member and the ground wire contact member. This configuration further enhances the noise resistance characteristics of the connector.

(11) A substrate according to one aspect of the present disclosure is a substrate on which a connector of any one of (1) to (10) above is mounted. This configuration provides a substrate that can transmit signals in which the crosstalk, which is one of the important transmission characteristics, is significantly improved in the shielded flat cable.

[Details of Embodiment of the Present Disclosure]

In the following, a preferred embodiment of the shielded flat cable of the present disclosure will be described with reference to the drawings. The following description assumes that components referenced by the same reference numeral are similar in different drawings, and the description may be omitted. Here, the present invention is not limited to examples of these embodiments, but includes all modifications within the scope of subject matters recited in the claims and the scope of equivalents. Additionally, the invention includes combinations of any embodiment as long as combinations are possible for embodiments. The drawings schematically describe embodiments according to the present disclosure, and the dimensions of the shielded flat cable are larger than the dimensions of the connector.

First Embodiment

Figure 2A:
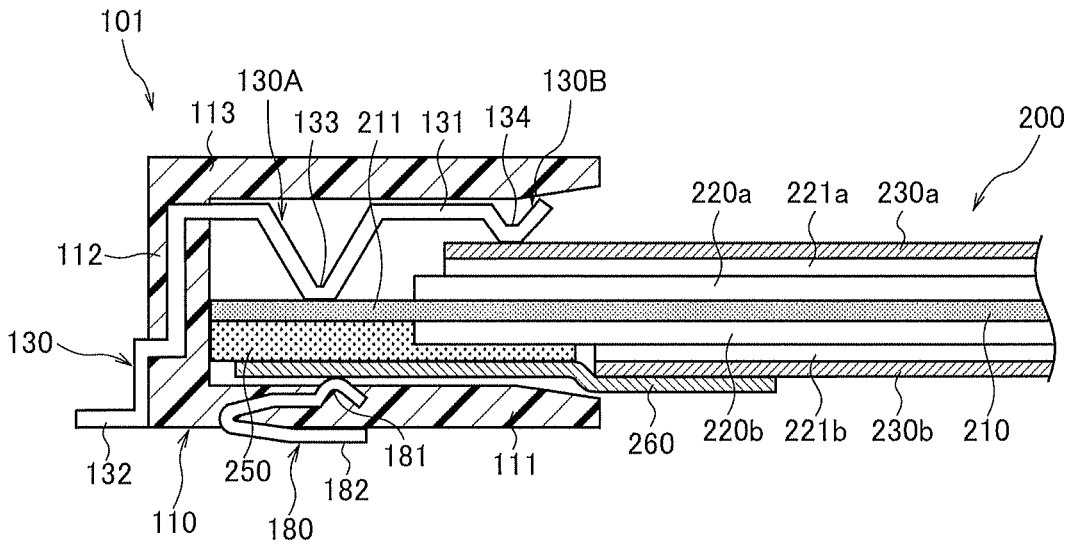
FIG. 2A is a drawing illustrating a cross-section along a line IIA-IIA in FIG. 1 and a cross-sectional view at a position of a ground wire contact member.
Figure 2B:
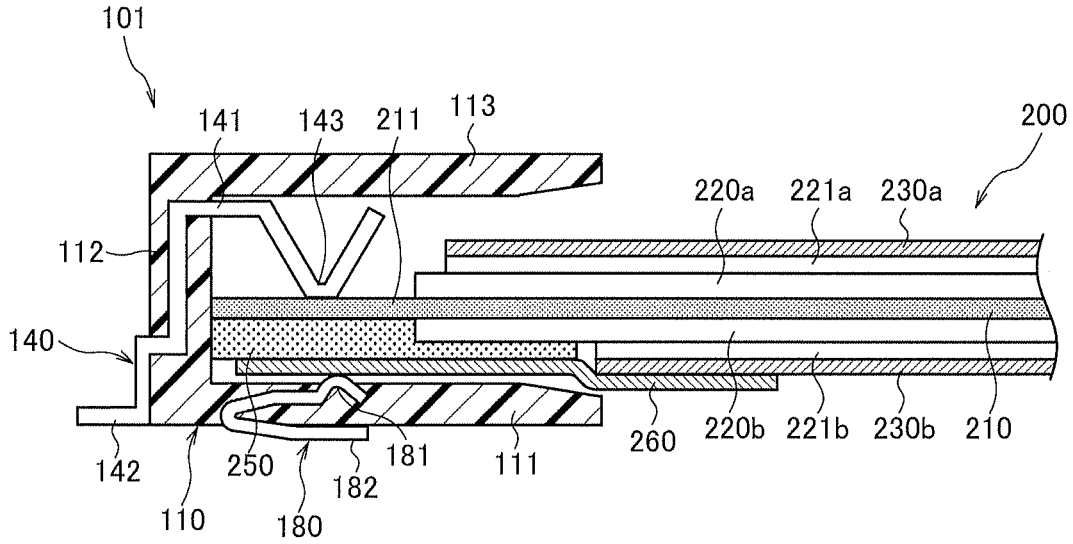
FIG. 2B is a drawing illustrating a cross-section along a line IIB-IIB in FIG. 1 and a cross-sectional view at a position of a signal wire contact member.

FIG. 1 is a top view illustrating a schematic view when a shielded flat cable is attached to a connector according to a first embodiment of the present disclosure. FIG. 2A is a drawing illustrating a cross-section along a line IIA-IIA in FIG. 1 and a cross-sectional view at a position of a ground wire contact member. FIG. 2B is a drawing illustrating a cross-section along a line IIB-IIB in FIG. 1 and a cross-sectional view at a position of a signal wire contact member.

A connector 101 according to the present embodiment is mounted on a printed circuit board (PCB), which is not illustrated, and electrically couples a shielded flat cable 200 to the printed circuit board. Respective solder tails 132 and 142 protruding from a casing 110 of the connector 101 are coupled to wires formed on the printed circuit board. A space in which the terminal of the shielded flat cable 200 can be attached is formed in the connector 101, and when the shielded flat cable 200 is attached to the connector 101, a predetermined conductor of the shielded flat cable 200 is configured to be connected to a predetermined wire of the printed circuit board.

Figure 3:
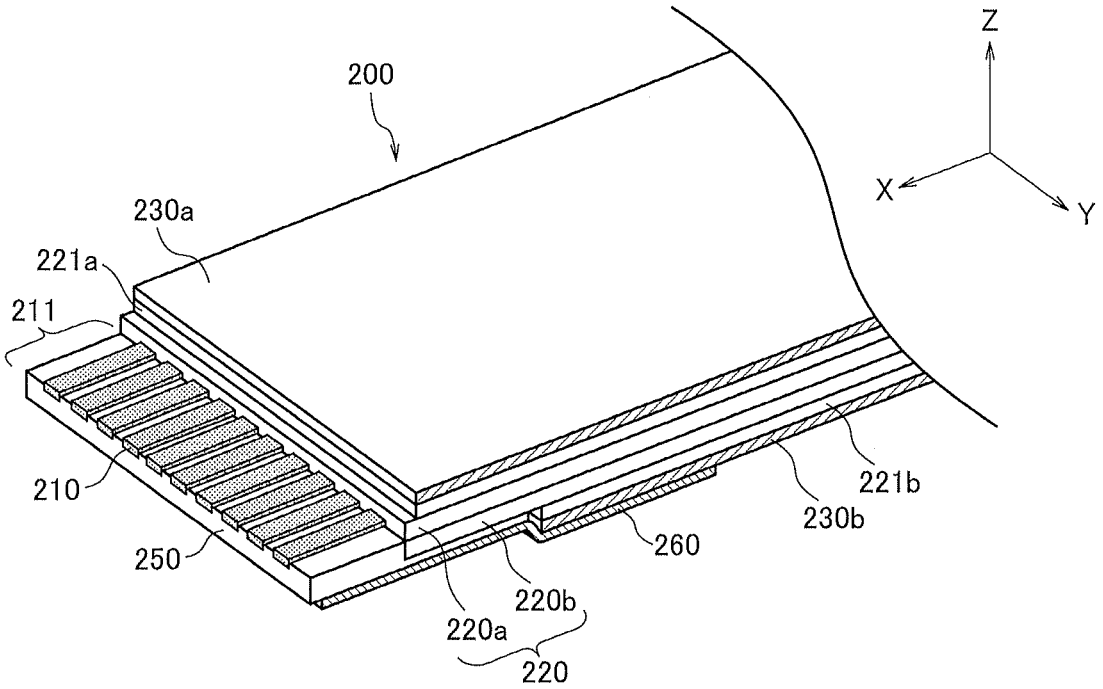
FIG. 3 is a perspective view illustrating an example of the shielded flat cable attached to the connector according to the present disclosure.
Figure 4:
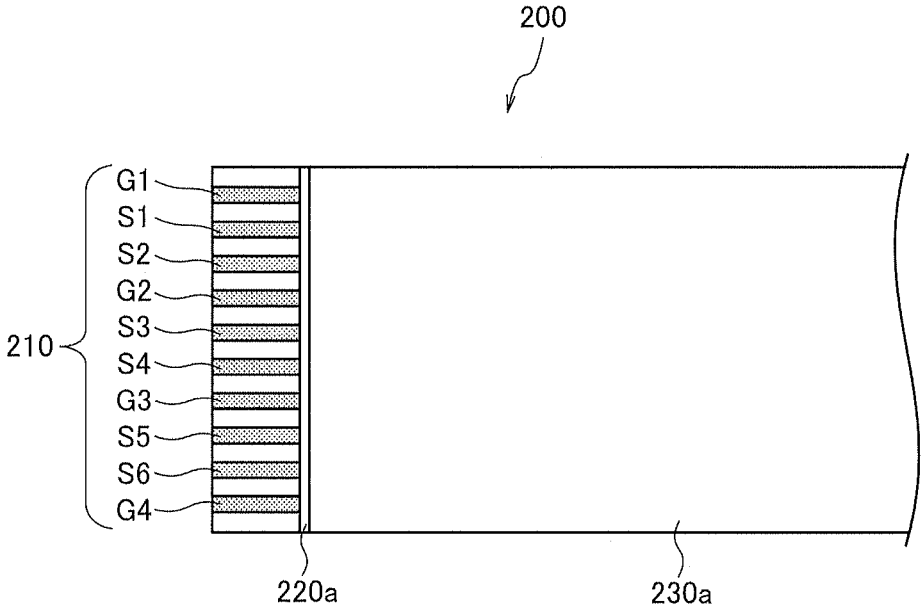
FIG. 4 is a drawing for describing an array of conductors of the shielded flat cable illustrated in FIG. 3.

Here, the shielded flat cable 200 attached to the connector 101 according to the present embodiment will be described. FIG. 3 is a perspective view illustrating an example of the shielded flat cable attached to the connector according to the present disclosure, and FIG. 4 is a drawing for describing an array of conductors of the shielded flat cable illustrated in FIG. 3.

The shielded flat cable 200 uses a flat cable in which both surfaces in a direction orthogonal to a parallel surface (i.e., an XY plane) of a flat conductor 210 (i.e., a Z-direction) are sandwiched between insulating layers 220*a* and 220*b* to form a seamless insulating layer 220. On at least one end of the shielded flat cable 200, in the present embodiment, one insulating layer 220*a* and the other insulating layer 220*b* are removed to form a cable terminal 211 with the flat conductor 210 being exposed. The cable terminal 211 comes in contact with a terminal of the connector 101 (i.e., a contact member) when the shielded flat cable 200 is attached to the connector 101. In order to expose the flat conductor 210, for example, only one insulating layer 220*a* may be removed and the other insulating layer 220*b* may be left to remain.

A reinforcing plate 250 is mounted to the other insulating layer 220*b* side of the cable terminal 211 for reinforcing. When the other insulating layer 220*b* is left to remain, the reinforcing plate 250 is mounted to the other insulating layer 220*b* at a position of the cable terminal 211. On both sides of the insulating layer 220 including one insulating layer 220*a* and the other insulating layer 220*b*, dielectric layers 221*a* and 221*b* are respectively bonded, and a first shield layer 230*a* and a second shield layer 230*b* are respectively bonded on the dielectric layers 221*a* and 221*b*. A cable terminal 211 side of the first shield layer 230*a* functions as a first shield layer connection to contact a first shield layer contact member, which will be described later. On the reinforcing plate 250, a second shield layer connection member 260 electrically coupled to the second shield layer 230*b* is provided. The second shield layer connection member 260 is electrically coupled to a second shield layer contact member of the connector, which will be described later.

The flat conductors 210 are each made of a metal, such as copper foil, tin-plated soft copper foil, for example, having a thickness of 12 μm to 100 μm, a width of about 0.2 mm to 0.8 mm, and are arrayed at suitable intervals with a pitch P of 0.4 mm to 1.5 mm. An array state of the flat conductors 210 is maintained by being sandwiched between insulating layers 220*a* and 220*b*. The flat conductor 210 is used for signal transmission, but a predetermined flat conductor 210 is dropped to the ground potential when the predetermined flat conductor 210 is coupled to the terminal of the connector on the printed circuit board side. For example, when the flat conductor 210 transmitting a signal is denoted by a signal wire Sn (where n is a positive integer) and the flat conductor 210 dropped to the ground potential is denoted by a ground wire Gm (where m is a positive integer), the flat conductors 210 are arrayed such that two signal wires S and one ground wire G are repeated in a parallel direction (i.e., the Y axis direction), such as G1-S1-S2-G2-S3-S4-G3-S5-S6-G4 as illustrated in FIG. 4. Here, two adjacent signal wires S are used for differential transmission. The ground wire provided on each side of the two signal wires for differential transmission is dropped to the ground potential with the shield layer, thereby significantly improving the transmission characteristics.

In addition to the above array, two signal wires S and two ground wires G may be repeatedly arrayed, such as G1-G2-S1-S2-G3-G4-S3-S4-G5-G6-S5-S6-G7-G8. In this case, an array of the ground wire contact member and the signal wire contact member, which will be described later, may be matched with an array of the ground wire G and the signal wire S of the shielded flat cable.

The insulating layers 220*a* and 220*b*, for example, have a two-layer structure including an adhesive layer on an inner surface of an insulating film. As the insulating film, a general resin film having a thickness of about 9 μm to 300 μm and excellent flexibility, such as a polyester resin, a polyphenylene sulfide resin, and a polyimide resin, is used. As the adhesive layer, for example, an adhesive made of a resin material formed by adding a flame retardant to a polyester-based resin or a polyolefin-based resin having a suitable thickness of 10 μm to 150 μm is used. The insulating layers 220*a* and 220*b* may be formed of, for example, a polyethylene monolayer resin instead of using an insulating film. As the first shield layer 230*a* and the second shield layer 230*b*, an aluminum foil or a copper foil provided with an adhesive layer or a resin layer, which has a thickness of approximately 30 μm as a whole, is used, for example.

The dielectric layers 221*a* and 221*b* are provided for adjusting the characteristic impedance of the shielded flat cable 200, but are not necessarily required to be provided. Protective layers may be provided on the first shield layer 230*a* and the second shield layer 230*b*. When the protective layers are provided, the protective layers may be provided throughout an entire external surface of the shielded flat cable 200, except on an end side of the first shield layer 230*a* and the second shield layer connection member 260.

Referring back to FIGS. 2A and 2B from FIG. 3, the connector 101 will be described. The connector 101 according to the present embodiment is an example of a Non-Zero Interpose Force (NON-ZIF) connector and includes a casing 110 made of an electrical insulating resin. The casing 110 includes a bottom 111, a side wall 112, and a top 113, and four types of contact members are fixed inside the casing 110.

A first contact member of the four types of contact members is a ground wire contact member 130A to contact the ground wire G of the shielded flat cable 200 and a second contact member is a first shield layer contact member 130B to contact the first shield layer 230*a* of the shielded flat cable 200. A third contact member is a signal wire contact member 140 to contact the signal wire S, and a fourth contact member is a second shield layer contact member 180 to contact the second shield layer connection member 260. In the present embodiment, the ground wire contact member 130A and the first shield layer contact member 130B are formed as a single seamless piece. The ground wire contact member 130A and the first shield layer contact member 130B, which are formed as a single seamless piece, are hereinafter referred to as a seamless ground wire contact member 130. The seamless ground wire contact member 130 is in one form for electrically coupling the ground wire contact member 130A to the first shield layer contact member 130B.

An array of the seamless ground wire contact member 130 and signal wire contact member 140 is arranged to correspond to an array of the ground wire G and signal wire S of the shielded flat cable 200 to be attached. For example, as illustrated in FIG. 4, when the flat conductors 210 of the shielded flat cable 200 are arrayed such that two signal wires S and one ground wire G are repeated, the seamless ground wire contact member 130 is disposed on each side of the two adjacent signal wire contact members 140.

FIG. 2A illustrates a cross-sectional view of an X-Z plane passing a center of the ground wire G when the shielded flat cable 200 is attached to the connector 101, and the shielded flat cable 200 is inserted into the connector 101 such that the exposed surface of the flat conductor 210 of the cable terminal 211 faces toward the top 113 of the connector 101.

As illustrated in FIG. 2A, the seamless ground wire contact member 130 includes an arm 131 and a solder tail 132 and is fixed to the side wall 112 at a portion from a base of the arm 131 to a base of the solder tail 132. The seamless ground wire contact member 130 is made of a metallic material that is conductive and that has a good spring property, such as brass or phosphor bronze. The arm 131 of the seamless ground wire contact member 130 seamlessly includes a ground wire contact 133 protruding toward the bottom 111 side on a base side (i.e., on a side wall 112 side) as the ground wire contact member 130A, and a first shield layer contact 134 protruding toward the bottom 111 side on a front end side (on a side opposite to the side wall 112 side) as the first shield layer contact member 130B. In the present embodiment, the ground wire contact 133 and the first shield layer contact 134 may be configured as an elastic protrusion.

A second shield layer contact member 180 is provided at a position facing the second shield layer connection member 260 of the shielded flat cable 200. The second shield layer contact member 180 is provided on the bottom 111 of the casing 110, and includes a second shield layer contact 181 to contact the second shield layer connection member 260 of the shielded flat cable 200 and a ground potential connection 182 connected to the wire of the ground potential of the substrate. When the connector 101 includes a metal shell, the ground potential connection 182 may be dropped to the ground potential of the substrate through the metal shell. A material of the second shield layer contact member 180, as well as the ground wire contact member 130A, is a metallic material that is conductive and that has a good spring property, such as brass or phosphor bronze.

In a state in which the shielded flat cable 200 is attached to the connector 101, the ground wire contact 133 of the ground wire contact member 130A is in contact with the ground wire G of the shielded flat cable 200, the first shield layer contact 134 is in contact with the ground wire G of the shielded flat cable 200, the first shield layer contact 134 is in contact with the first shield layer 230*a* of the shielded flat cable 200, and the second shield layer contact 181 of the second shield layer contact member 180 is in contact with the second shield layer connection member 260. The dimensions of the shielded flat cable 200 and each contact member are adjusted to obtain suitable contact pressure. The first shield layer contact 134, the second shield layer contact 181, and the ground wire contact 133 are positioned in order from an input side of the insertion direction of the shielded flat cable 200. The solder tail 132 is connected to a wiring pad dropped to the ground potential of the printed circuit board, which is not illustrated, by using solder, for example.

Thus, the ground wire G and the first shield layer 230*a* of the shielded flat cable 200 are dropped to the ground potential of the printed circuit board through the seamless ground wire contact member 130, and the second shield layer 230*b* of the shielded flat cable 200 is also dropped to the ground potential of the printed circuit board through the second shield layer connection member 260 and the second shield layer contact member 180.

As illustrated in FIG. 2B, the signal wire contact member 140 includes an arm 141 and a solder tail 142, and is fixed to the side wall 112 at a portion from a base of the arm 141 to a base of the solder tail 142. A material of the signal wire contact member 140, as well as the ground wire contact member 130A, is a metallic material that is conductive and has a good spring property, such as brass and phosphor bronze. The arm 141 of the signal wire contact member 140 seamlessly includes a signal wire contact 143 protruding toward a bottom 111 side on a base side (i.e., on a side wall 112 side). In the present embodiment, the signal wire contact member 140 is formed to be shorter than the seamless ground wire contact member 130 along the direction of insertion of the shielded flat cable.

A second shield layer contact member 180, which is similar to the second shield layer contact member 180 illustrated in FIG. 2A, may be provided at a position facing the second shield layer connection member 260 of the shielded flat cable 200. The second shield layer contact member 180 can be provided at not only the positions illustrated in FIGS. 2A and 2B but any position, because the second shield layer contact member 180 can be electrically coupled to the second shield layer 230*b* when the second shield layer contact member 180 comes in contact with the second shield layer connection member 260 of the shielded flat cable 200, which is provided in a planar shape. In the present embodiment, the description assumes that the second shield layer contact member 180 is at the illustrated position.

The dimensions of each portion are adjusted such that in a state in which the shielded flat cable 200 is attached to the connector 101, the signal wire contact 143 of the signal wire contact member 140 comes in contact with the signal wire S of the shielded flat cable 200, and the second shield layer contact 181 of the second shield layer contact member 180 comes in contact with the second shield layer connection member 260. The solder tail 142 is connected to a wiring pad of the printed circuit board for the signal, which is not illustrated, by using solder, for example. Thus, the signal wire S of the shielded flat cable 200 is connected to signal wiring of the printed circuit board through the signal wire contact member 140, and the second shield layer 230*b* of the shielded flat cable 200 is also dropped to the ground potential of the printed circuit board through the second shield layer connection member 260 and the second shield layer contact member 180.

The connector 101 according to the present embodiment is effective when the first shield layer 230*a* and the second shield layer 230*b* of the shielded flat cable 200 are electrically coupled, but is particularly effective when the first shield layer 230*a* and the second shield layer 230*b* are respectively formed on the insulating layers 220*a* and 220*b* independently, that is, when the first shield layer 230*a* and the second shield layer 230*b* provided on the upper and lower surfaces are not electrically coupled. In this case, the connector 101 can drop the first shield layer 230*a*, which is one surface of the shielded flat cable 200, to the ground potential of the substrate through the seamless ground wire contact member 130 and can drop the second shield layer 230*b*, which is the other surface of the shielded flat cable 200, to the ground potential of the substrate through the second shield layer contact member 180.

A method for attaching the shielded flat cable 200 to the connector 101 is inserting the shielded flat cable 200 through an opening opposite to the side wall 112 of the casing 110 and pushing an end of the shielded flat cable 200 at a predetermined position, for example, where the end of the shielded flat cable 200 comes in contact with the side wall 112. When the shielded flat cable 200 is removed from the connector 101, the shielded flat cable 200 may be pulled out from the connector 101.

Second Embodiment

Figure 5:
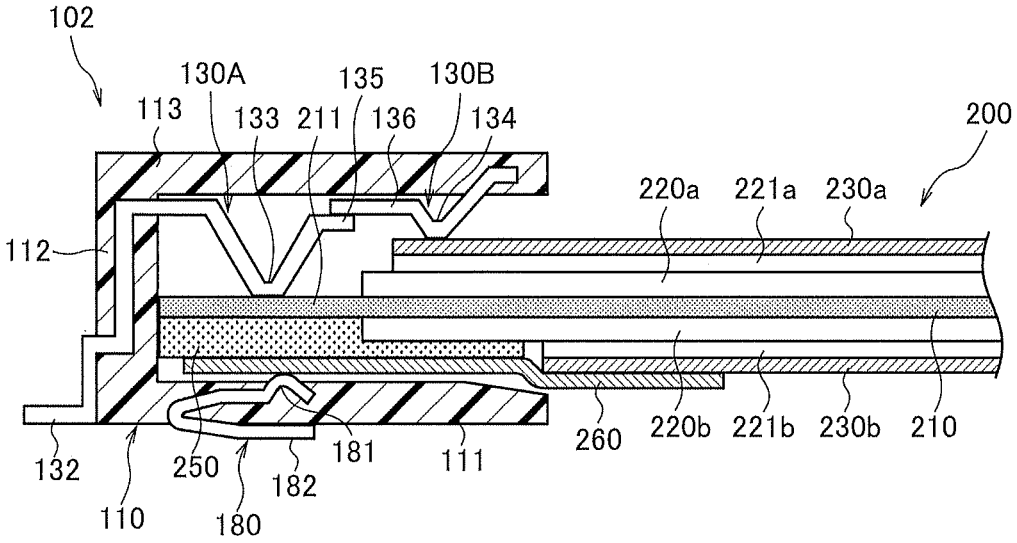
FIG. 5 is a cross-sectional view at a position of a ground wire contact member when the shielded flat cable is attached to a connector according to a second embodiment of the present disclosure.

FIG. 5 is a cross-sectional view at a position of a ground wire contact member when the shielded flat cable is attached to a connector according to a second embodiment of the present disclosure. In the present embodiment, the cross-section and the configuration of the signal wire contact member are the same as the cross-section and the configuration of the signal wire contact member in the first embodiment. Thus, the drawings and the description are omitted.

In the connector 101 according to the first embodiment illustrated in FIG. 2A, the ground wire contact member 130A and the first shield layer contact member 130B are formed as a single seamless piece. In a connector 102 according to the present embodiment, the ground wire contact member 130A and the first shield layer contact member 130B are separately formed. The ground wire contact member 130A is fixed to the side wall 112 of the casing 110 and includes the ground wire contact 133 protruding toward the bottom 111 side, and the solder tail 132. The first shield layer contact member 130B is fixed to the top 113 of the casing 110, for example, and includes the first shield layer contact 134 protruding toward the bottom 111 side. A connection piece 135 is provided in the ground wire contact member 130A, and a connection piece 136 that can contact the connection piece 135 is provided in the first shield layer contact member 130B.

When the shielded flat cable 200 is attached to the connector 102 according to the present embodiment, the ground wire contact 133 of the ground wire contact member 130A comes in contact with the ground wire G of the shielded flat cable 200, and the first shield layer contact 134 of the first shield layer contact member 130B comes in contact with the first shield layer 230*a* of the shielded flat cable 200. At the same time, the connection piece 135 provided in the ground wire contact member 130A and the connection piece 136 provided in the first shield layer contact member 130B are in contact with each other. Thus, the first shield layer 230*a* of the shielded flat cable 200 is dropped to the ground potential of the printed circuit board, which is not illustrated, with the ground wire G through the first shield layer contact member 130B and the ground wire contact member 130A.

Other components are similar to the components of the connector 101 in the first embodiment, and the description is omitted.

In the present embodiment, because the ground wire contact member 130A and the first shield layer contact member 130B are separately configured, the pressing force of each contact member in contacting the shielded flat cable 200 can be individually adjusted.

Third Embodiment

Figure 6A:
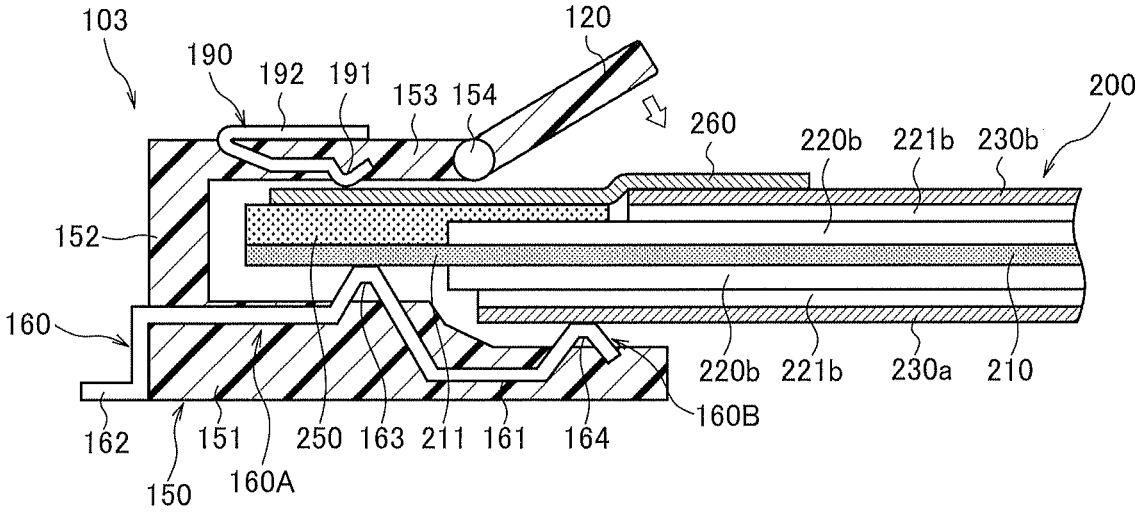
FIG. 6A is a cross-sectional view at a position of a ground wire contact member when the shielded flat cable is attached to a connector according to a third embodiment of the present disclosure.
Figure 6B:
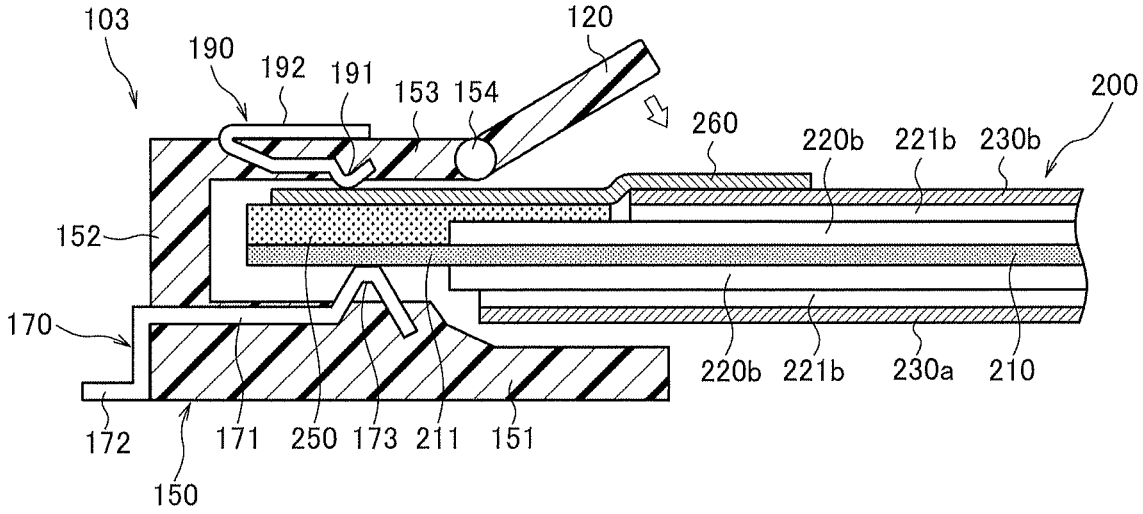
FIG. 6B is a cross-sectional view at a position of a signal wire contact member when the shielded flat cable is attached to the connector according to the third embodiment of the present disclosure.

FIG. 6A is a cross-sectional view at a position of a ground wire contact member when the shielded flat cable is attached to a connector according to a third embodiment of the present disclosure, and FIG. 6B is a cross-sectional view at a position of a signal wire contact member when the shielded flat cable is attached to the connector according to the third embodiment of the present disclosure.

A connector 103 according to the present embodiment is another example of a Zero Interpose Force (ZIF) connector and includes a casing 150 made of an electrically insulating resin. The casing 150 includes a bottom 151, a side wall 152, and a top 153. A hinge 154 is provided at a front end of the top 153, and the flip-lock member 120 is rotatably mounted through the hinge 154.

In the present embodiment, the shielded flat cable 200 is inserted into the connector 103 such that an exposed surface of the flat conductor 210 of the cable terminal 211 faces toward the bottom 151 of the connector 103. In the present embodiment, as in the first embodiment, four types of contact members are fixed in the casing 150. A first contact member of the four types of contact members is a ground wire contact member 160A to contact the ground wire G of the shielded flat cable 200, and a second contact member is a first shield layer contact member 160B to contact the first shield layer 230*a* of the shielded flat cable 200. A third contact member is a signal wire contact member 170 to contact the signal wire S, and a fourth contact member is a second shield layer contact member 190 to contact a second shield layer connection member 260.

As illustrated in FIG. 6A, in the present embodiment, the ground wire contact member 160A and the first shield layer contact member 160B are formed as a single seamless piece.

A seamless ground wire contact member 160 is one form for electrically coupling the ground wire contact member 160A to the first shield layer contact member 160B. The ground wire contact member 160A and the first shield layer contact member 160B that are formed as a single seamless piece are hereinafter referred to as a seamless ground wire contact member 160. Thus, in the bottom 151 and the side wall 152 of the casing 150, two types of contact members, which are the seamless ground wire contact member 160 and the signal wire contact member 170, are provided. Additionally, in the top 153, a second shield layer contact member 190 is provided. The array of the seamless ground wire contact member 160 and the signal wire contact member 170 are arranged to respectively correspond to the ground wire G and signal wire S of the shielded flat cable 200 to be attached.

As illustrated in FIG. 6A, the seamless ground wire contact member 160 includes an arm 161 and a solder tail 162, and the seamless ground wire contact member 160 is seamlessly manufactured with the bottom 151 and side wall 152 of the casing 150, for example, by insert molding. The seamless ground wire contact member 160 is made of a metallic material that is conductive and has a good spring property, such as brass or phosphor bronze. The arm 161 of the seamless ground wire contact member 160 includes a ground wire contact 163 protruding toward a top 153 side on a base side (on a side wall 152 side) as the ground wire contact member 160A and the first shield layer contact 164 protruding toward the top 153 side on a front end side (on a side opposite to the side wall 152 side) as the first shield layer contact member 160B. The solder tail 162 provided in a portion protruding from the side wall 152 is coupled to the wiring pad of the printed circuit board (not illustrated), which is the ground potential, by solder, for example.

A second shield layer contact member 190 is provided at a position facing the second shield layer connection member 260 of the shielded flat cable 200. The second shield layer contact member 190 is provided at the top 153 of the casing 150 and includes a second shield layer contact 191 to contact the second shield layer connection member 260 of the shielded flat cable 200, and a ground potential connection 192. The ground potential connection 192 is connected to a metal shell that is dropped to the ground potential of the substrate. A material of the second shield layer contact member 190, as well as the seamless ground wire contact member 160, is a metallic material that is conductive and has a good spring property, such as brass and phosphor bronze.

The dimensions of each portion are adjusted such that in a state in which the shielded flat cable 200 is attached to the connector 103, the ground wire contact 163 of the seamless ground wire contact member 160 comes in contact with the ground wire G of the shielded flat cable 200, the first shield layer contact 164 comes in contact with the first shield layer 230*a* of the shielded flat cable 200, and the second shield layer contact 191 of the second shield layer contact member 190 comes in contact with the second shield layer connection member 260. The solder tail 162 is connected to the wiring pad of the printed circuit board of the ground potential, which is not illustrated, by using solder, for example.

The flip-lock member 120 is rotated in the arrow direction to, with certainty, cause the ground wire contact 163 to contact the ground wire G of the shielded flat cable 200 and cause the first shield layer contact 164 to contact the first shield layer 230*a* of the shielded flat cable 200, and prevent the shielded flat cable 200 from being removed from the connector 103 with a mechanism that is not illustrated. Thus, the ground wire G and the first shield layer 230*a* of the shielded flat cable 200 are dropped to the ground potential of the printed circuit board through the seamless ground wire contact member 160, and the second shield layer 230*b* of the shielded flat cable 200 is also dropped to the ground potential of the printed circuit board through the second shield layer connection member 260, the second shield layer contact member 190, and the metal shell of the connector 103.

As illustrated in FIG. 6B, the signal wire contact member 170 includes an arm 171 and a solder tail 172, and the signal wire contact member 170 is seamlessly manufactured with the bottom 151 and the side wall 152 of the casing 150, for example, by insert molding. A material of the signal wire contact member 170, as well as the seamless ground wire contact member 160, is a metallic material that is conductive and that has a good spring property, such as brass and phosphor bronze. The arm 171 of the signal wire contact member 170 seamlessly includes a signal wire contact 173 protruding toward the top 153 side on a base side (i.e., a side wall 152 side). In the present embodiment, the signal wire contact member 170 is formed to be shorter than the seamless ground wire contact member 160 along the insertion direction of the shielded flat cable.

A second shield layer contact member 190 in FIG. 6B, which is similar to the second shield layer contact member 190 illustrated in FIG. 6A, is provided at a position facing the second shield layer connection member 260 of the shielded flat cable 200. The second shield layer contact member 190 may be disposed at not only the positions illustrated in FIGS. 6A and 6B, but any position because the second shield layer contact member 190 can be electrically coupled to the second shield layer 230*b* when the second shield layer contact member 190 contacts the second shield layer connection member 260 of the shielded flat cable 200, which is provided in a planar shape. In the present embodiment, the following description assumes that the second shield layer contact members 190 are in the positions illustrated in the drawings.

The dimensions of each portion are adjusted such that in a state in which the shielded flat cable 200 is attached to the connector 103, the signal wire contact 173 of the signal wire contact member 170 comes in contact with the signal wire S of the shielded flat cable 200, and the second shield layer contact 191 of the second shield layer contact member 190 comes in contact with the second shield layer connection member 260. The solder tail 172 is connected to the wiring pad of the printed circuit board for the signal, which is not illustrated, by using solder, for example. The flip-lock member 120 is rotated in the arrow direction to cause the signal wire contact 173 to contact the signal wire S of the shielded flat cable 200 with certainty, and prevent the shielded flat cable 200 from being removed from the connector 103.

Thus, the signal wire S of the shielded flat cable 200 is coupled to the signal wiring of the printed circuit board through the signal wire contact member 170, and the second shield layer 230*b* of the shielded flat cable 200 is also dropped to the ground potential of the printed circuit board through the second shield layer connection member 260, the second shield layer contact member 190, and the metal shell of the connector 103.

The connector 103 according to the present embodiment, as well as the connector 101 according to the first embodiment, is effective when the first shield layer 230*a* and the second shield layer 230*b* of the shielded flat cable 200 are electrically coupled, but is particularly effective when the first shield layer 230*a* and the second shield layer 230*b* are respectively formed on the insulating layers 220*a* and 220*b* independently, that is, the first shield layer 230*a* and the second shield layer 230*b* provided on the upper and lower surfaces are not electrically coupled. In this case, the connector 103 enables the first shield layer 230*a* on one side of the shielded flat cable 200 to be dropped to the ground potential of the substrate through the seamless ground wire contact member 160 or enables the second shield layer 230*b* on the other side of the shielded flat cable 200 to be dropped to the ground potential of the substrate through the second shield layer contact member 190.

A method of attaching the shielded flat cable 200 to the connector 103 is inserting the shielded flat cable 200 through an opening opposite to the side wall 152 of the casing 150 with the flip-lock member 120 being pivoted in a direction opposite to the arrow direction (i.e., a counterclockwise direction). The front end of the shielded flat cable 200 is inserted to a predetermined position, which is, for example, a position contacting the side wall 152. The flip-lock member 120 is rotated in the arrow direction (i.e., a clockwise direction). When the shielded flat cable 200 is removed from the connector 103, the flip-lock member 120 is rotated in a direction opposite to the arrow direction, and the shielded flat cable 200 is pulled out from the connector 103.

Fourth Embodiment

Figure 7:
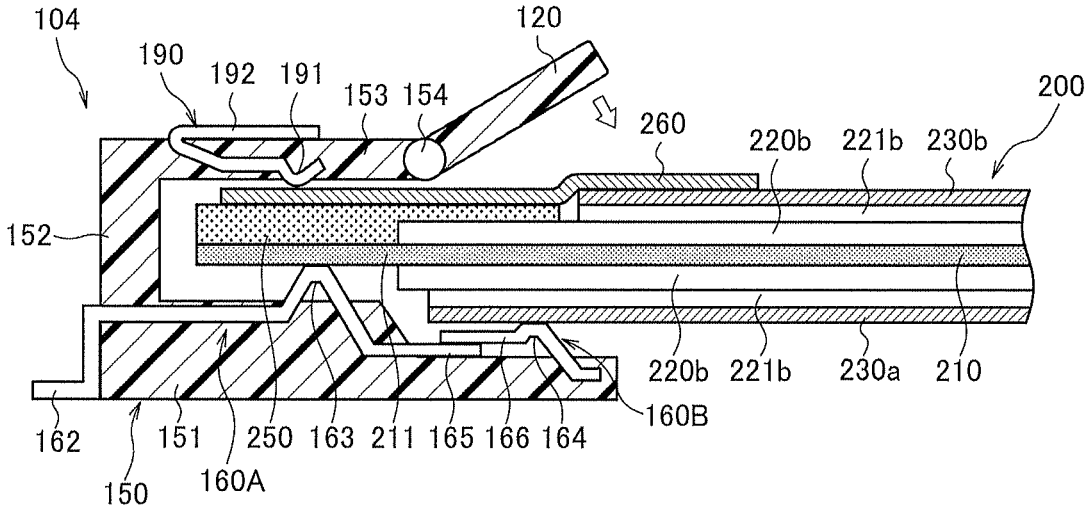
FIG. 7 is a cross-sectional view at a position of a ground wire contact member when the shielded flat cable is attached to a connector according to a fourth embodiment of the present disclosure.

FIG. 7 is a cross-sectional view at a position of the ground wire contact member when the shielded flat cable is attached to a connector according to a fourth embodiment of the present disclosure. In the present embodiment, the cross-section and the configuration of the signal wire contact member are the same as the cross-section and the configuration of the signal wire contact member in the third embodiment illustrated in FIG. 6B. Thus, the drawings and the description are omitted.

In the connector 103 according to the third embodiment illustrated in FIG. 6A, the ground wire contact member 160A and the first shield layer contact member 160B are formed as a single seamless piece. In a connector 104 according to the present embodiment, the ground wire contact member 160A and the first shield layer contact member 160B are separately configured. The ground wire contact member 160A is fixed to the side wall 152 and the bottom 151 of the casing 150 and includes the ground wire contact 163 protruding toward the top 153 side, and the solder tail 162. The first shield layer contact member 160B is fixed to the bottom 151 of the casing 150, for example, and includes the first shield layer contact 164 protruding toward the top 153 side. A connection piece 165 is provided in the ground wire contact member 160A, and a connection piece 166 that can contact the connection piece 165 is provided in the first shield layer contact member 160B.

When the shielded flat cable 200 is attached to the connector 104 according to the present embodiment, the ground wire contact 163 of the ground wire contact member 160A comes in contact with the ground wire G of the shielded flat cable 200, and the first shield layer contact 164 of the first shield layer contact member 160B comes in contact with the first shield layer 230*a* of the shielded flat cable 200. At the same time, the connection piece 165 provided in the ground wire contact member 160A is in contact with the connection piece 166 provided in the first shield layer contact member 160B. Thus, the first shield layer 230*a* of the shielded flat cable 200 is dropped to the ground potential of the printed circuit board, which is not illustrated, with the ground wire G through the first shield layer contact member 160B and the solder tail 162 of the ground wire contact member 160A. Other components are similar to the components of the connector 103 in the third embodiment, and the description is omitted.

In the present embodiment, the ground wire contact member 160A and the first shield layer contact member 160B are separately configured, so that the pressing force of each contact member in contacting the shielded flat cable 200 can be individually adjusted.

(Transmission Characteristics)

Figure 8:
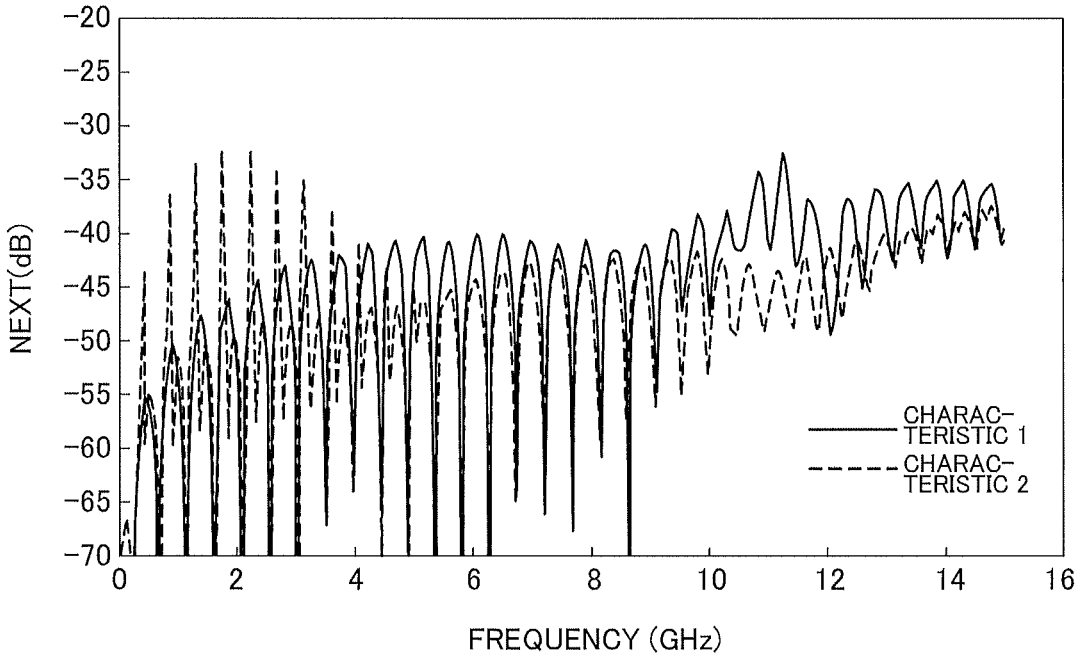
FIG. 8 is a graph illustrating characteristics of near-end crosstalk (NEXT) measured when a potential of a shield layer of the shielded flat cable is dropped to a ground potential through a metal shell in a case in which a connector includes a metal shell and when the embodiment of the present disclosure is used.
Figure 9:
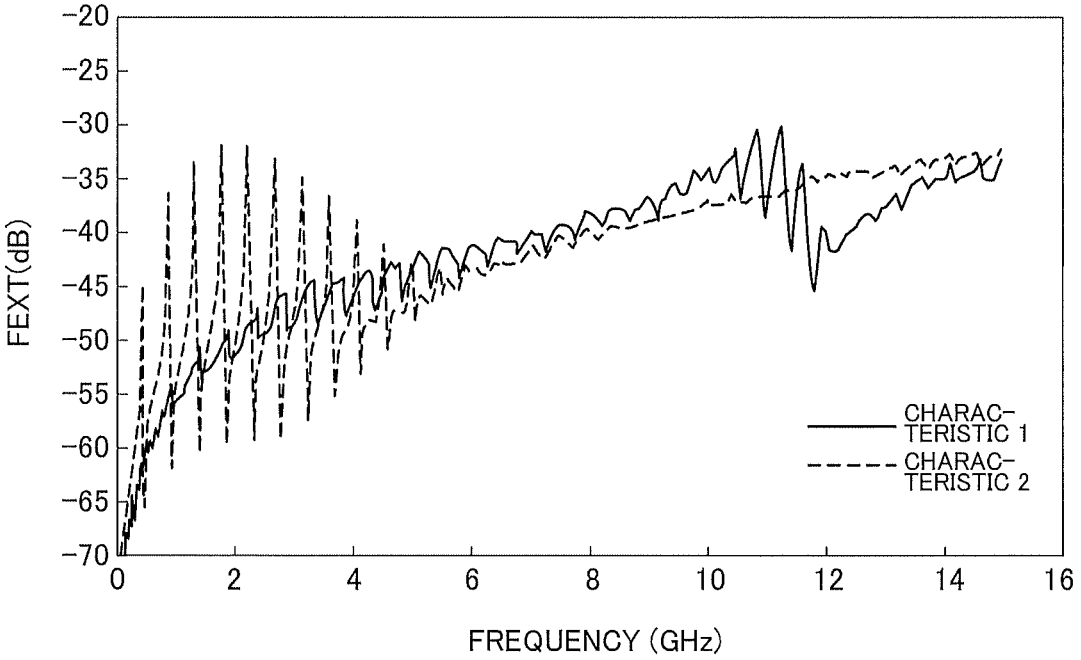
FIG. 9 is a graph illustrating characteristics of far-end crosstalk (FEXT) measured when a potential of a shield layer of the shielded flat cable is dropped to a ground potential through a metal shell in a case in which a connector includes a metal shell and when the embodiment of the present disclosure is used.

Next, the transmission characteristics of the connector according to the present disclosure will be described. FIG. 8 is a graph illustrating the characteristics of near-end crosstalk (NEXT) measured when the shield layer of the shielded flat cable is dropped to the ground potential through the metal shell in a case in which the connector includes a metal shell, and when the embodiment of the present disclosure is used, and FIG. 9 is a graph illustrating the characteristics of far-end crosstalk (FEXT) measured when the shield layer of the shielded flat cable is dropped to ground potential through a metal shell in a case in which the connector includes a metal shell, and when the embodiment of the present disclosure is used. Both indicate the attenuation of the signal with respect to the frequency; the solid line, which is a characteristic 1, indicates the attenuation of the signal measured when the embodiment of the present disclosure is used and the dashed line, which is a characteristic 2, indicates the attenuation of the signal measured when a metal shell is used conventionally.

As illustrated in FIG. 8, with respect to near-end crosstalk, the crosstalk in a frequency band of approximately 4 GHz or smaller is significantly reduced when the embodiment of the present disclosure is used, compared with the crosstalk measured when the metal shell is used, and variations are also reduced. Although the crosstalk in a frequency band of approximately 4 GHz or greater that is measured when the embodiment of the present disclosure is used is slightly greater than the crosstalk measured when the metal shell is used, it is not a problem because the crosstalk is smaller than or equal to −30 dB.

As illustrated in FIG. 9, with respect to far-end crosstalk, the crosstalk in a frequency band of approximately 5 GHz or smaller is significantly reduced when the embodiment of the present disclosure is used, compared with the crosstalk measured when the metal shell is used, and the variations are also significantly reduced. Although the crosstalk in a frequency band from approximately 5 GHz to approximately 12 GHz that is measured when the embodiment of the present disclosure is used is slightly greater than the crosstalk measured when the metal shell is used, the crosstalk in a frequency band of approximately 12 GHz or greater is significantly reduced when the embodiment of the present disclosure is used, compared with the crosstalk measured when the metal shell is used.

Therefore, it can be found that even when a connector including a metal shell is used, the transmission characteristics of the NEXT and the FEXT are better when the shield layer and the ground wire G are dropped to the ground potential through the contact member by using the connector according to the embodiment of the present disclosure, compared with the transmission characteristics measured when the shield layer of the shielded flat cable is dropped to the ground potential by using the metal shell of the connector as illustrated by the characteristic 2.

Fifth Embodiment

Figure 10:
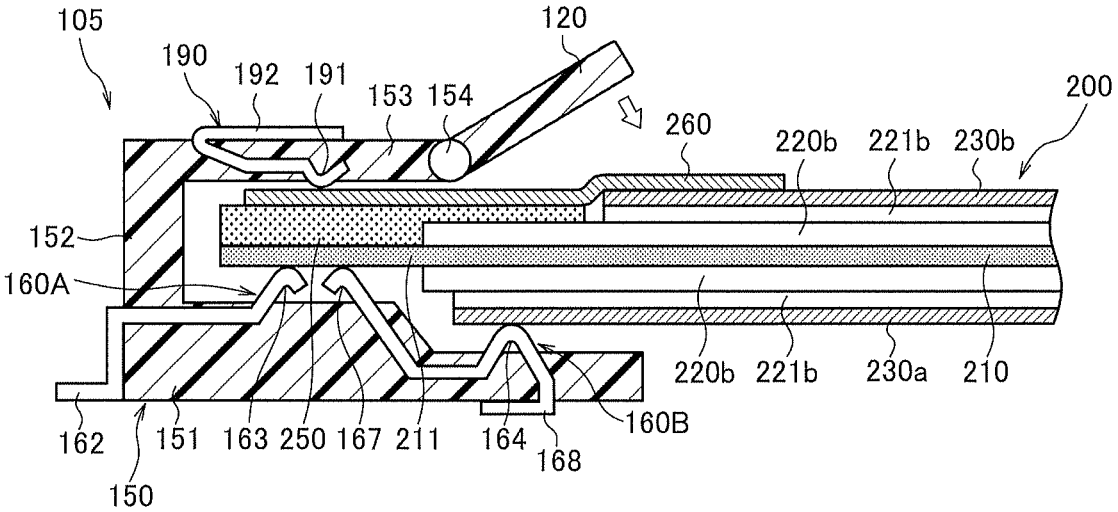
FIG. 10 is a cross-sectional view at a position of a ground wire contact member when the shielded flat cable is attached to a connector according to a fifth embodiment of the present disclosure.

FIG. 10 is a cross-sectional view at a position of a ground wire contact member when the shielded flat cable is attached to a connector according to a fifth embodiment of the present disclosure. In the present embodiment, the cross-section and the configuration of the signal wire contact member are the same as the cross-section and the configuration of the signal wire contact member in the third embodiment illustrated in FIG. 6B. Thus, the drawings and the description are omitted.

In a connector 105 according to the present embodiment, the ground wire contact member 160A and the first shield layer contact member 160B are separately configured. The ground wire contact member 160A is fixed to the side wall 152 and the bottom 151 of the casing 150 and includes the ground wire contact 163 protruding toward the top 153 side, and a solder tail 162. The first shield layer contact member 160B is fixed to the bottom 151 of the casing 150, for example, and includes a first shield layer contact 164 protruding toward the top 153 side and a ground wire contact 167 similarly protruding toward the top 153 side. Further, although the first shield layer contact member 160B includes a ground potential connection 168, the ground potential connection 168 may not be provided.

When the shielded flat cable 200 is attached to the connector 105 according to the present embodiment, the ground wire contact 163 of the ground wire contact member 160A comes in contact with the ground wire G of the shielded flat cable 200, and the first shield layer contact 164 of the first shield layer contact member 160B comes in contact with the first shield layer 230*a* of the shielded flat cable 200. At the same time, the ground wire contact 167 of the first shield layer contact member 160B comes in contact with the ground wire G of the shielded flat cable 200. Thus, the first shield layer 230*a* of the shielded flat cable 200 is dropped to the ground potential of the printed circuit board, which is not illustrated, with the ground wire G through the first shield layer contact member 160B, the ground wire G, and the solder tail 162 of the ground wire contact member 160A.

When the ground potential connection 168 is provided to the first shield layer contact member 160B, the first shield layer 230*a* and the ground wire G of the shielded flat cable 200 are further dropped to the ground potential of the printed circuit board, which is not illustrated, through the ground potential connection 168. The present embodiment is an example of electrically coupling the ground wire contact member 160A and the first shield layer contact member 160B by using the ground wire G of the shielded flat cable 200. Other components are similar to the components of the connector 103 in the third embodiment, and the description will be omitted.

Sixth Embodiment

Figure 11:
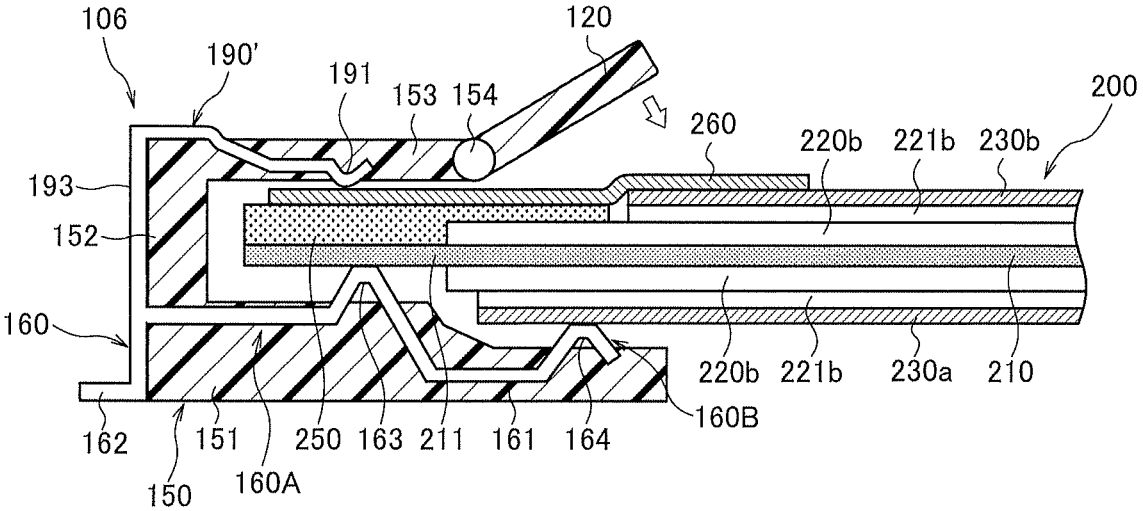
FIG. 11 is a cross-sectional view at a position of a ground wire contact member when the shielded flat cable is attached to a connector according to a sixth embodiment of the present disclosure.

FIG. 11 is a cross-sectional view at a position of the ground wire contact member when the shielded flat cable is attached to a connector according to a sixth embodiment of the present disclosure. The connector 106 according to the present embodiment includes the seamless ground wire contact member 160 in which the ground wire contact member 160A to contact the ground wire G of the shielded flat cable 200 and the first shield layer contact member 160B to contact the first shield layer 230*a* of the shielded flat cable 200 are formed as a single seamless piece, as in the third embodiment illustrated in FIG. 6A. In the connector 106, a second shield layer contact member 190' is provided at a position facing the second shield layer connection member 260 of the shielded flat cable 200. The second shield layer contact member 190' includes a second shield layer contact 191 to contact the second shield layer connection member 260 of the shielded flat cable 200 and a connection piece 193 extending to the ground wire contact member 160A.

In a state in which the shielded flat cable 200 is attached to the connector 106, the ground wire contact 163 of the seamless ground wire contact member 160 comes in contact with the ground wire G of the shielded flat cable 200, and the first shield layer contact 164 comes in contact with the first shield layer 230*a* of the shielded flat cable 200. Further, the second shield layer contact 191 of the second shield layer contact member 190' comes in contact with the second shield layer connection member 260. This causes the ground wire G, the first shield layer 230*a*, and the second shield layer 230*b* of the shielded flat cable 200 to be dropped to the ground potential of the printed circuit board, which is not illustrated, through the common solder tail 162.

In the example illustrated in FIG. 11, the second shield layer contact member 190' is fixed to the top 153 of the casing 150, but the second shield layer contact member 190' may be fixed to the side wall 152. The connection piece 193 is electrically coupled to the ground wire contact member 160A outside the casing 150, but the connection piece 193 may be coupled to the ground wire contact member 160A in a space inside the casing 150.

Further, the seamless ground wire contact member 160 and the second shield layer contact member 190' may be formed as a single seamless piece.

Seventh Embodiment

Figure 12A:
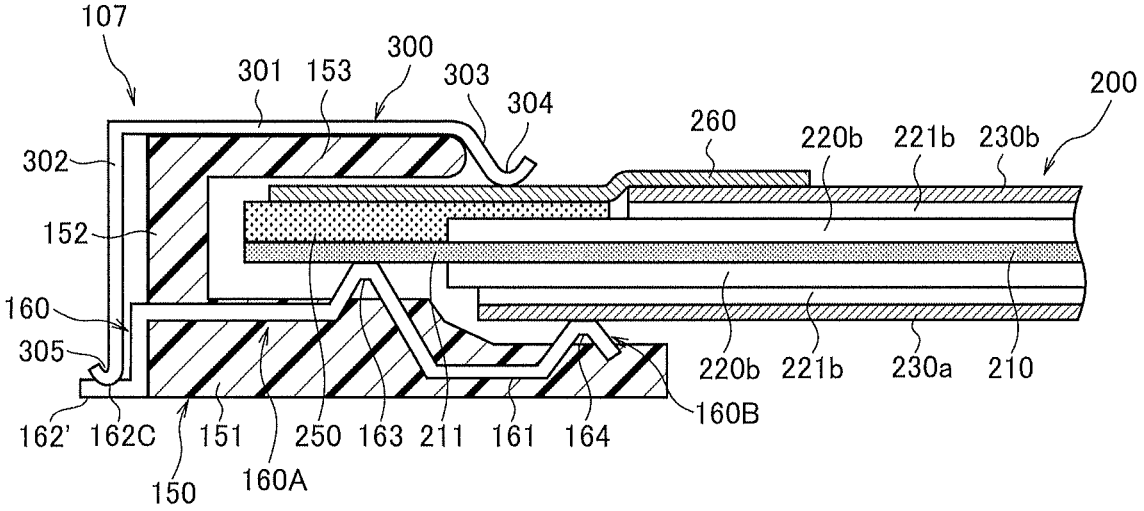
FIG. 12A is a cross-sectional view at a position of a ground wire contact member when the shielded flat cable is attached to a connector according to a seventh embodiment of the present disclosure.
Figure 12B:
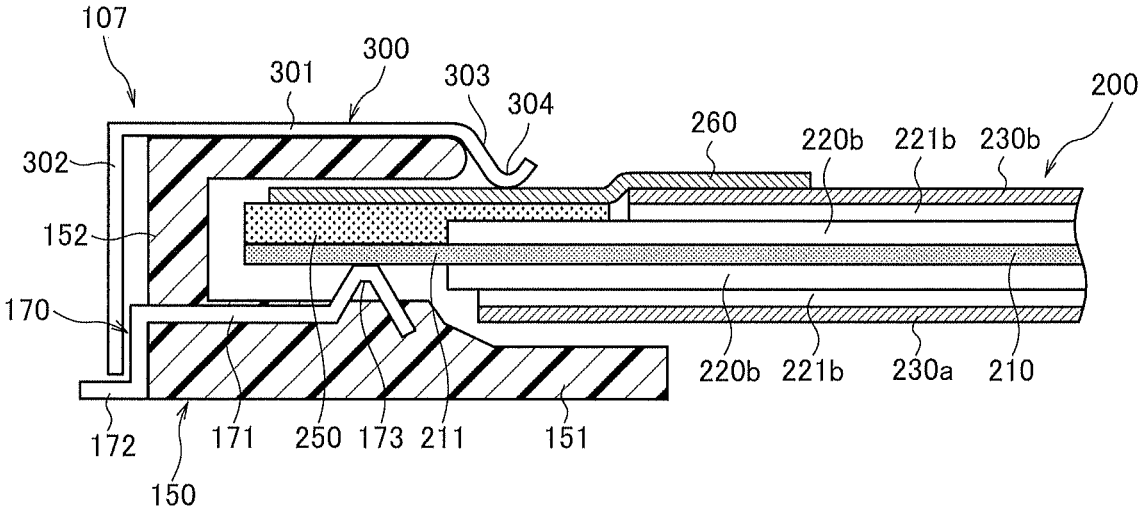
FIG. 12B is a cross-sectional view at a position of a signal wire contact member when the shielded flat cable is attached to a connector according to the seventh embodiment of the present disclosure.
Figure 13:
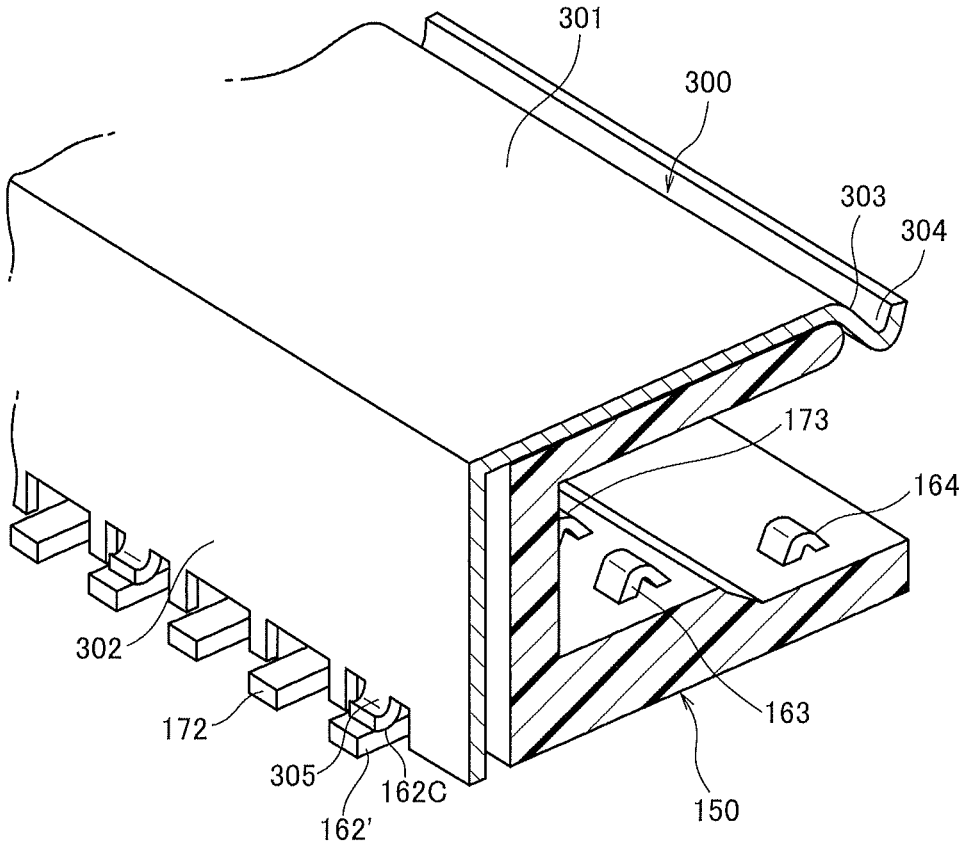
FIG. 13 is a perspective view of the connector according to the seventh embodiment of the present disclosure.

FIG. 12A is a cross-sectional view at a position of a ground wire contact member when the shielded flat cable is attached to a connector according to a seventh embodiment of the present disclosure, and FIG. 12B is a cross-sectional view at a position of a signal wire contact member when the shielded flat cable is attached to the connector according to the seventh embodiment of the present disclosure. FIG. 13 is a perspective view of the connector according to the seventh embodiment of the present disclosure.

The connector 107 according to the present embodiment is an example of the NON-ZIF connector and includes the casing 150 made of an electrically insulating resin and a metal shell 300. The casing 150 includes the bottom 151, the side wall 152, and the top 153, and three types of contact members are fixed inside the casing 150. A first contact member of the three types of contact members is the ground wire contact member 160A to contact the ground wire G of the shielded flat cable 200 and a second contact member is the first shield layer contact member 160B to contact the first shield layer 230*a* of the shielded flat cable 200. A third contact member is a signal wire contact member 170 to contact the signal wire S.

In the present embodiment, the connector 107 includes the seamless ground wire contact member 160 in which the ground wire contact member 160A and the first shield layer contact member 160B are formed as a single seamless piece. In a solder tail 162' of the seamless ground wire contact member 160, a recess 162C that receives a contact piece 305 of the metal shell 300, which will be described later, is provided on an upper surface side. The signal wire contact member 170 includes the arm 171 and the solder tail 172, and the configuration of the signal wire contact member 170 is similar to the configuration in the third embodiment.

The metal shell 300 includes a top surface 301 covering the top 153 of the casing 150 and a side surface 302 covering the side wall 152 of the casing 150. The metal shell 300 further seamlessly includes a second shield layer contact member 303 extending from the top surface 301 to a direction opposite to the side surface 302 beyond the top 153 of the casing 150. The second shield layer contact member 303 includes a second shield layer contact 304, which is a protrusion protruding toward a bottom 151 side of the casing 150, and the second shield layer contact 304 contacts the second shield layer connection member 260. In the side surface 302 of the metal shell 300, a contact piece 305 extending toward a solder tail 162' side and that elastically contacts the recess 162C of the solder tail 162' is provided at a position facing the solder tail 162' of the seamless ground wire contact member 160. In the present embodiment, the contact piece 305 is configured as a protrusion with a curved tip.

In a state in which the shielded flat cable 200 is attached to the connector 107 according to the present embodiment, the ground wire contact 163 of the seamless ground wire contact member 160 comes in contact with the ground wire G of the shielded flat cable 200, and the first shield layer contact 164 comes in contact with the first shield layer 230*a* of the shielded flat cable 200. The signal wire contact 173 of the signal wire contact member 170 comes in contact with the signal wire S of the shielded flat cable 200. Further, the second shield layer contact 304 of the metal shell 300 comes in contact with the second shield layer connection member 260 of the shielded flat cable 200. This causes the first shield layer 230*a* of the shielded flat cable 200 to be dropped to the ground potential of the printed circuit board, which is not illustrated, with the ground wire G through the first shield layer contact member 1608 and the solder tail 162' of the ground wire contact member 160A. The second shield layer 230*b* of the shielded flat cable 200 is also dropped to the ground potential of the printed circuit board, which is not illustrated, through the metal shell 300 and the solder tail 162' of the ground wire contact member 160A.

Figure 14:
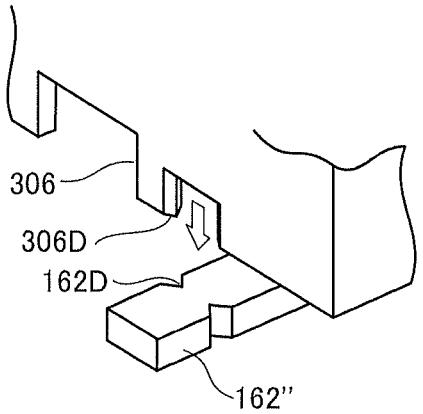
FIG. 14 is a drawing illustrating an example of a connection between a solder tail of the ground wire contact member and a metal shell of the connector according to the seventh embodiment of the present disclosure.

In the embodiment described above, the contact piece 305 provided in the metal shell 300 elastically contacts the recess 162C formed on the solder tail 162', so that the solder tail 162' and the metal shell 300 are electrically coupled, but another configuration may be used. FIG. 14 is a drawing illustrating an example of a connection between the solder tail of the ground wire contact member and the metal shell of the connector according to the seventh embodiment of the present disclosure. In the example illustrated in FIG. 14, a notch 162D is provided on a solder tail 162" of the seamless ground wire contact member 160 to fit a projecting part 306D provided on a side surface of the contact piece 306 of the metal shell 300, so that the solder tail 162" and the metal shell 300 are electrically coupled.

In the present embodiment, the metal shell 300 is dropped to the ground potential through the solder tail 162' or 162" of the ground wire contact member 160A, but the metal shell 300 may be directly dropped to the ground potential of the printed circuit board, which is not illustrated. For example, side surfaces that cover both sides of the flat conductors 210 of the shielded flat cable 200 in a parallel direction (i.e., in the Y-axis direction of FIG. 3) may be seamlessly provided to the metal shell 300 and the side surfaces may be directly connected to the wiring pad of the ground potential of the printed circuit board. As described above, in the present embodiment, because the metal shell 300 covers the casing 150, the noise resistance of the connector 107 is enhanced.

Eighth Embodiment

Figure 15:
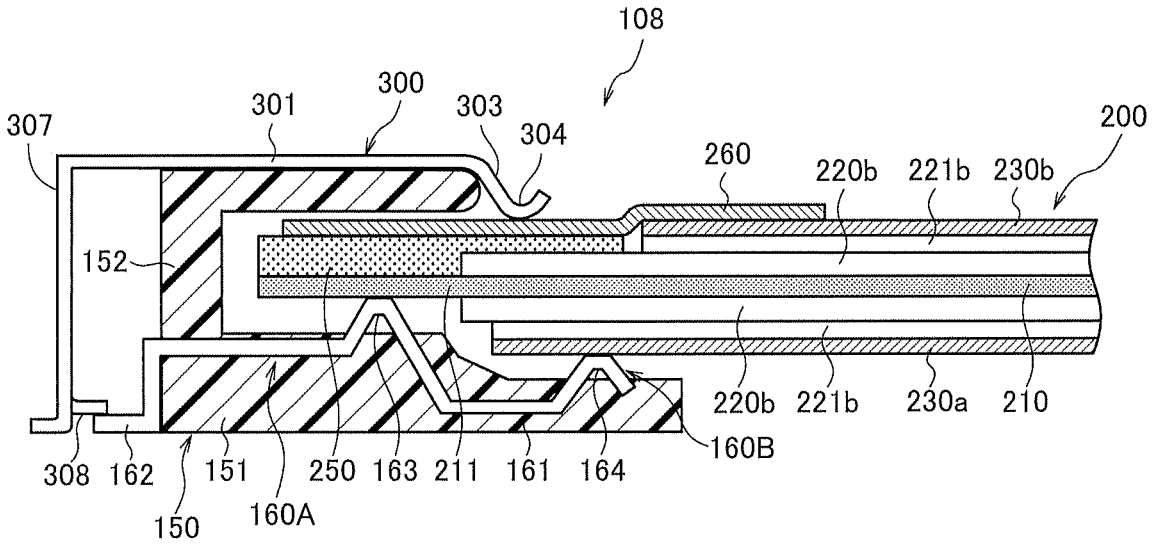
FIG. 15 is a cross-sectional view at a position of the ground wire contact member when the shielded flat cable is attached to a connector according to an eighth embodiment of the present disclosure.
Figure 16:
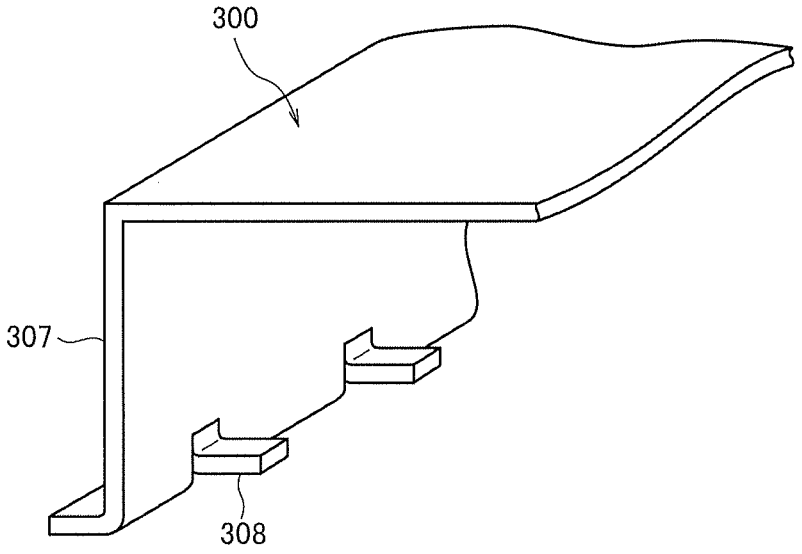
FIG. 16 is a drawing illustrating a metal shell of the connector according to the eighth embodiment of the present disclosure.

FIG. 15 is a cross-sectional view at a position of a ground wire contact member when the shielded flat cable is attached to a connector according to an eighth embodiment of the present disclosure, and FIG. 16 is a drawing illustrating a metal shell of the connector according to the eighth embodiment of the present disclosure. A connector 108 in the present embodiment is similar to the connector in the seventh embodiment in including the metal shell 300, but the connector 108 is different from the connector in the seventh embodiment in that the metal shell 300 includes a cover 307 covering the solder tail 162. An electrical connection between the metal shell 300 and the solder tail 162 of the ground wire contact member 160A is achieved by causing a connection piece 308 provided in the cover 307 to contact the solder tail 162. The connection piece 308 is formed by cutting and raising a portion of the cover 307, as illustrated in FIG. 16, but another configuration may be used.

In a state in which the shielded flat cable 200 is attached to the connector 108 according to the present embodiment, the ground wire contact 163 of the seamless ground wire contact member 160 comes in contact with the ground wire G of the shielded flat cable 200, and the first shield layer contact 164 comes in contact with the first shield layer 230*a* of the shielded flat cable 200. A signal wire contact 173 of the signal wire contact member 170, which is not illustrated, comes in contact with the signal wire S of the shielded flat cable 200. Further, a second shield layer contact 304 of the metal shell 300 comes in contact with the second shield layer connection member 260 of the shielded flat cable 200. This causes the first shield layer 230*a*, the ground wire G, and the second shield layer 230*b* of the shielded flat cable 200 to be dropped to the ground potential of the printed circuit board, which is not illustrated, through the solder tail 162 of the ground wire contact member 160A.

Although the embodiments of the present disclosure have been described, neither of the embodiments requires special processing for connecting the shield layer to the ground wire, such as attaching a toothcomb conductor or performing wire bonding, with respect to the shielded flat cable. When the NON-ZIF connector is used, the height of the connector can be lowered. Here, the present invention is not limited to the configuration of each embodiment, as long as the connector is a connector to which a shielded flat cable including a ground wire and a shield layer can be attached and is in a form in which the contact members of the connector can contact the ground wire and the shield layer. Any substrate may be used as long as the connector of the present invention is mounted on the substrate. Further, multiple embodiments have been described, but as described earlier, as long as a combination of these embodiments is possible, the present invention includes the combination of any embodiments.

DESCRIPTION OF THE REFERENCE NUMERALS

101, 102, 103, 104, 105, 106, 107, 108 connector
110 casing
111 bottom
112 side wall
113 top
120 flip-lock member
130 seamless ground wire contact member
130*a* ground wire contact member
130*b* first shield layer contact member
131 arm
132 solder tail
133 ground wire contact
134 first shield layer contact
135 connection piece

136 connection piece
140 signal wire contact member
141 arm
142 solder tail
143 signal wire contact
150 casing
151 bottom
152 side wall
153 top
154 hinge
160 seamless ground wire contact member
160*a* ground wire contact member
160*b* first shield layer contact member
161 arm
162 solder tail
162' solder tail
162*c* recess
162*d* notch
163 ground wire contact
164 first shield layer contact
165 connection piece
166 connection piece
167 ground wire contact
168 ground potential connection
170 signal wire contact member
171 arm
172 solder tail,
173 signal wire contact
180 second shield layer contact member
181 second shield layer contact
182 ground potential connection
190 second shield layer contact member
190' second shield layer contact member
191 second shield layer contact
192 ground potential connection
193 connection piece
200 shielded flat cable
210 flat conductor
211 cable terminal
220 insulating layer
220*a* insulating layer
220*b* insulating layer
221*a* dielectric layer
221*b* dielectric layer
230 shield layer
230*a* first shield layer
230*b* second shield layer
250 reinforcing plate
260 second shield layer connection member
300 metal shell
301 top surface
302 side surface
303 second shield layer contact member
304 second shield layer contact
305, 306 contact piece
306D projecting part
307 cover
308 connection piece

The invention claimed is:

1. A connector for attachment to a shielded flat cable including a signal wire and a ground wire arranged in parallel, an insulating layer covering the signal wire and the ground wire, and a first shield layer and a second shield layer respectively covering both sides of the insulating layer, wherein a terminal in which the signal wire and the ground wire are exposed on a first shield layer side at an end in a longitudinal direction is formed, the connector comprising a casing, wherein the casing includes a bottom to face the first shield layer or the second shield layer, a top to face the first shield layer or the second shield layer, and a side wall connected to the bottom and the top, the connector further comprising:

a signal wire contact member configured to come in contact with the signal wire of the terminal upon the shielded flat cable being attached;

a ground wire contact member configured to come in contact with the around wire of the terminal upon the shielded flat cable being attached;

a first shield layer contact member configured to come in contact with the first shield layer upon the shielded flat cable being attached; and a second shield layer contact member configured to be electrically coupled to the second shield layer upon the shielded flat cable being attached, wherein the ground wire contact member is electrically coupled to the first shield layer contact member, and wherein the second shield layer contact member is formed in a metal shell member covering the casing, as a single seamless piece.

2. The connector as claimed in claim 1, wherein the ground wire contact member and the first shield layer contact member are formed as a single seamless piece.

3. The connector as claimed in claim 2, wherein the ground wire contact member and the first shield layer contact member that are formed as the single seamless piece are longer than the signal wire contact member along an insertion direction of the shielded flat cable.

4. The connector as claimed in claim 1, wherein a contact position where the first shield layer is in contact with the first shield layer contact member, a contact position where the second shield layer is in contact with the second shield layer contact member, and a contact position where the ground wire is in contact with the ground wire contact member are positioned in this order from an input side of an insertion direction of the shielded flat cable.

5. The connector as claimed in claim 1, wherein the ground wire contact member is electrically coupled to the second shield layer contact member.

6. The connector as claimed in claim 1, wherein the ground wire contact member is disposed on each side of two adjacent said signal wire contact members.

7. The connector as claimed in claim 1, wherein the metal shell member includes a connection for connecting to a wiring pad of ground potential of a substrate on which the connector is mounted.

8. The connector as claimed in claim 1, wherein the metal shell member includes a connection piece for connecting to a solder tail of the ground wire contact member.

9. The connector as claimed in claim 1, wherein the metal shell member includes a cover member covering solder tails of the signal wire contact member and the ground wire contact member.

10. A substrate on which the connector as claimed in claim 1 is mounted.

* * * * *